US008128281B2

(12) United States Patent
Hadley et al.

(10) Patent No.: US 8,128,281 B2
(45) Date of Patent: Mar. 6, 2012

(54) FLUID LEVEL INDICATION SYSTEM AND TECHNIQUE

(75) Inventors: Maxwell Richard Hadley, Lyndhurst Hampshire (GB); Dylan H. Davies, Stroud (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/768,085

(22) Filed: Apr. 27, 2010

(65) Prior Publication Data

US 2010/0208766 A1 Aug. 19, 2010

Related U.S. Application Data

(60) Division of application No. 11/940,367, filed on Nov. 15, 2007, now Pat. No. 7,731,421, which is a continuation-in-part of application No. 11/767,576, filed on Jun. 25, 2007, now Pat. No. 7,472,594.

(51) Int. Cl.

| | |
|---|---|
| ***G01K 13/00*** | (2006.01) |
| ***G01K 3/00*** | (2006.01) |
| ***G01K 1/00*** | (2006.01) |
| ***G01N 25/00*** | (2006.01) |

(52) U.S. Cl. ..... 374/136; 374/137; 374/45; 374/208

(58) Field of Classification Search ..... 374/136, 374/137, 45, 208

See application file for complete search history.

(56) References Cited

U.S. PATENT DOCUMENTS

| | | | | |
|---|---|---|---|---|
| 2,290,075 | A * | 7/1942 | Schlumberger | 73/152.13 |
| 2,739,475 | A * | 3/1956 | Nowak | 73/152.12 |
| 3,709,032 | A * | 1/1973 | Coles et al. | 73/152.13 |
| 4,616,705 | A * | 10/1986 | Stegemeier et al. | 166/250.01 |
| 5,348,093 | A * | 9/1994 | Wood et al. | 166/250.14 |
| 2007/0186640 | A1 * | 8/2007 | Johnson et al. | 73/152.52 |
| 2008/0236836 | A1 * | 10/2008 | Weng | 166/336 |

* cited by examiner

*Primary Examiner* — Lisa Caputo
*Assistant Examiner* — Mirellys Jagan
(74) *Attorney, Agent, or Firm* — Brandon S. Clark; Rodney Warfford

(57) ABSTRACT

A technique that is usable with a well includes changing the temperature of a local environment of a distributed temperature sensor, which is deployed in a region of the well and using the sensor to acquire measurements of a temperature versus depth profile. The region contains at least two different well fluid layers, and the technique includes determining the depth of a boundary of at least one of the well fluid layers based at least in part on a response of the temperature versus depth profile to the changing of the temperature.

1 Claim, 17 Drawing Sheets

FLUID LEVEL INDICATION SYSTEM AND TECHNIQUE

This Application is a divisional of U.S. patent application Ser. No. 11/940,367 filed Nov. 15, 2007, which is pending, which is a continuation-in-part of U.S. patent application Ser. No. 11/767,576 entitled, "FLUID LEVEL INDICATION SYSTEM AND TECHNIQUE," which was filed on Jun. 25, 2007, and is hereby incorporated by reference in its entirety.

BACKGROUND

The invention generally relates to a fluid level indication system and technique.

In oil fields it is typically important to know the levels of the fluids in the reservoir and around wells, and in particular, it may be important to know the depths of the interfaces between the gas, oil and water layers. Such knowledge is particularly important in secondary and tertiary recovery systems, for example, in steam flooding applications in heavy oil reservoirs.

Traditionally, the depths of the interfaces between the fluid levels are determined using pressure measurements. For example, one approach involves using a single pressure sensor, which makes a series of pressure measurements at multiple depths. The measured pressure is plotted against the depth. In each of the gas, oil and water layers, the pressure gradient is constant and proportional to the density of the fluid. The depths of the fluid layer interfaces, or boundaries, are identified by the intersections of the pressure gradient lines. The above-described technique of identifying the interface depths using a pressure sensor typically works well when carried out in an intervention in the well using, for example, a wireline-deployed tool.

For purposes of permanently monitoring the depths of the fluid interfaces, an array of pressure sensors may be placed across the gas, oil and water layers. In this regard, the pressure gradients may be plotted and the analysis that is set forth above may be applied. If the depths of the interfaces change over time, a large number of pressure sensors may be required to accurately assess the interface depths. A large number of pressure sensors may also be required if the initial positions of the interfaces are unknown or uncertain. However, several challenges may arise with the use of a large number of pressure sensors, such as challenges related to compensating the pressure readings for sensor offset and drift. Furthermore, the cost of an array of pressure sensors can be high and prohibitive.

Downhole distributed temperature sensing (DTS) involves the use of a sensor that indicates a temperature versus depth distribution in the downhole environment. DTS typically is used to identify and quantify production from different injection/production zones of a well.

For example, in a technique called "hot slug tracking," DTS may be used to identify the permeable zones in a water injector well where injected fluid enters the formation. The permeable zones typically cannot be identified by DTS during normal injection. However, by shutting off injection and allowing the water in the tubing or casing above the injection zone to be heated up towards the geothermal gradient, a heated "slug" may be created. When the injection is re-started, the hot slug may be tracked versus time using the DTS measurements to identify the permeable zones.

SUMMARY

In an embodiment of the invention, a technique that is usable with a well includes changing the temperature of a local environment of a distributed temperature sensor, which is deployed in a region of the well and using the sensor to acquire measurements of a temperature versus depth profile. The region contains at least two different well fluid layers, and the technique includes determining the depth of a boundary of at least one of the well fluid layers based at least in part on a response of the temperature versus depth profile to the changing of the temperature.

In another embodiment of the invention, a technique that is usable with a well includes deploying first and second sensor cables in a region of the well, which contains at least two well fluid layers. The first sensor cable includes a first distributed temperature sensor, and the second sensor cable includes a second distributed temperature sensor and a heating element. The technique includes activating the heating element and determining the depth of a boundary of at least one of the well fluid layers based at least in part on responses of temperature versus depth profiles that are indicated by the first and second distributed temperature sensors to the activation of the heater.

In another embodiment of the invention, a system that is usable with a well includes a region that contains at least two different well fluid layers. The system includes a distributed temperature measurement subsystem and a second subsystem. The distributed temperature measurement subsystem includes a distributed temperature sensor to traverse the region and indicate a temperature versus depth profile. The second subsystem changes the temperature of a local environment of the distributed temperature sensor. The distributed temperature measurement subsystem is adapted to observe a response of the temperature versus depth profile to the change in temperature such that the response identifies at least one boundary of the well fluid layers.

In yet another embodiment of the invention, a system that is usable with a well that contains at least two well fluid layers includes a first cable, a second cable, a power source and a distributed temperature measurement subsystem. The first cable is to be deployed in a region of the well and includes a first distributed temperature sensor. The second cable is to be deployed in the region of the well and includes a second distributed temperature sensor and a heating element. The power source is adapted to selectively activate the heating element, and the distributed temperature measurement subsystem is coupled to the first and second distributed temperature sensors.

Advantages and other features of the invention will become apparent from the following drawing, description and claims.

DETAILED DESCRIPTION

In accordance with embodiments of the invention described herein, the depths of different well fluid layer interfaces (interfaces between oil, gas and water layers, as examples) are determined using one or more distributed temperature sensing (DTS) measurements. Each DTS measurement reveals a temperature versus depth distribution, or profile, in a region of interest 71 of a well, which traverses the well fluid layers. At least one distributed temperature sensor (an optical fiber, for example) is deployed downhole and extends along the region of interest 71, and as described herein, the sensor(s) are locally heated or cooled. The depths of the well fluid interfaces are determined based on the response(s) of the sensor(s) to the local temperature change (s). As described in more detail below, the local temperature of a distributed temperature sensor that is deployed in the well may be changed through fluid circulation and/or the activation of one or more downhole heating elements.

In accordance with some embodiments of the invention, the local temperature of the distributed temperature sensor may be changed by changing the temperature of a fluid in a conduit (pipe, tubing, or control line, as just a few examples of a "conduit") that contains the sensor. As set forth by way of specific examples herein, the DTS measurements may be conducted in connection with two different types of tests: 1.) a first test (called a "relaxation test" herein) in which the measured temperature versus depth profile is used to observe the fluid's temperature relaxation after circulation of the fluid in the conduit has been halted; and 2.) a second test (called a "steady state test" herein) in which the temperature versus depth profile is used to observe the fluid's steady state temperature while the fluid is being continuously circulated in the conduit. The relaxation temperature versus depth profile and the steady state temperature versus depth profile each reveals the locations (i.e., depths) of the well fluid interfaces, as further described below.

Figure 1:
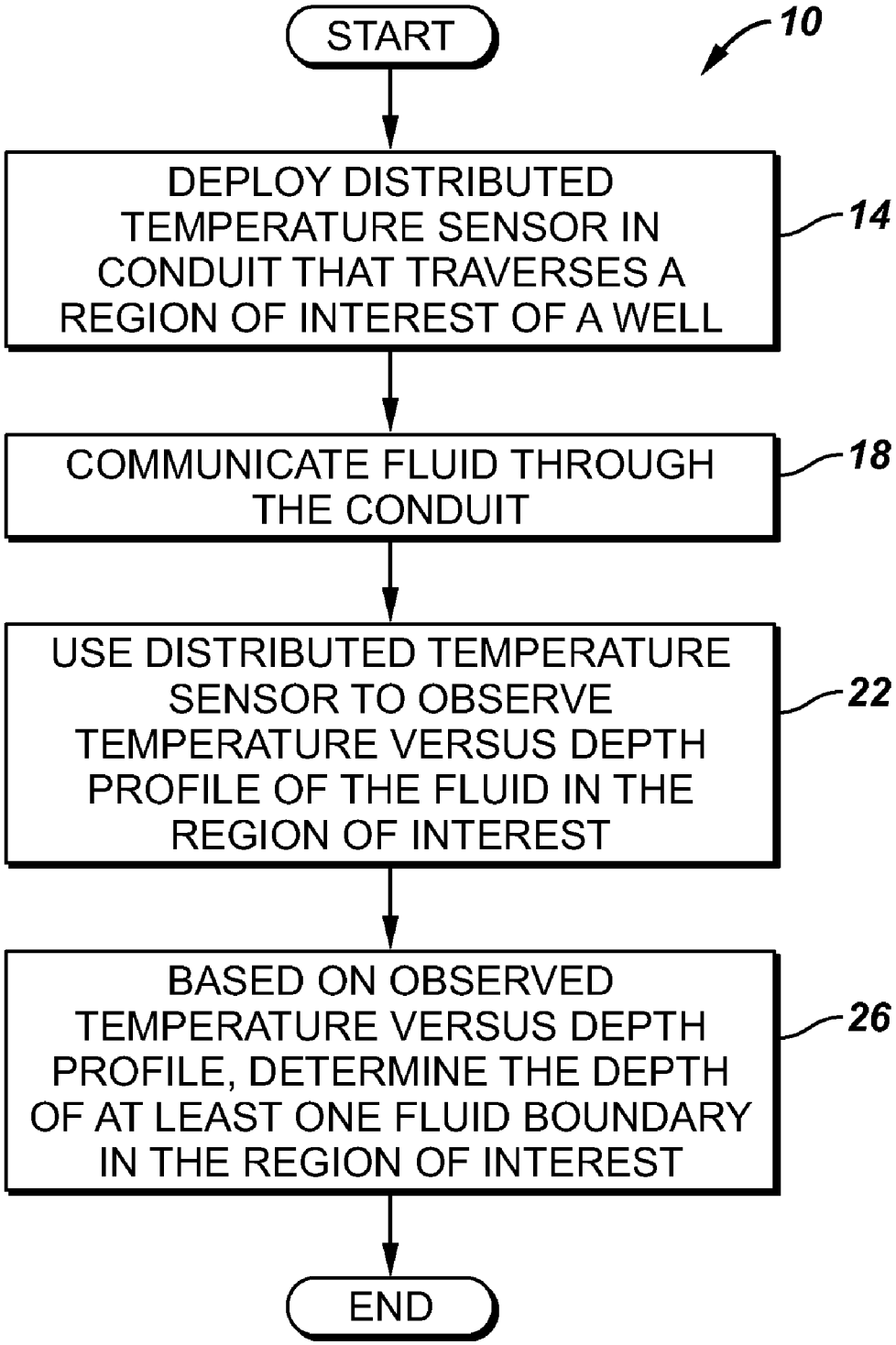
FIG. 1 is a flow diagram generally depicting a technique to use a distributed temperature sensor to determine the depth of at least one well fluid layer boundary according to an embodiment of the invention.

To generalize, FIG. 1 depicts a technique 10 that may be used in accordance with embodiments of the invention. Pursuant to the technique 10, a distributed temperature sensor is deployed (block 14) in a conduit that traverses a region of interest of a well, and fluid is communicated through the conduit, as depicted in block 18. The distributed temperature sensor is used to observe (block 22) the temperature versus depth profile of the fluid; and based on the observed temperature profile, the depth of at least one well fluid layer boundary in the region of interest 71 may be identified, pursuant to block 26.

Figure 2:
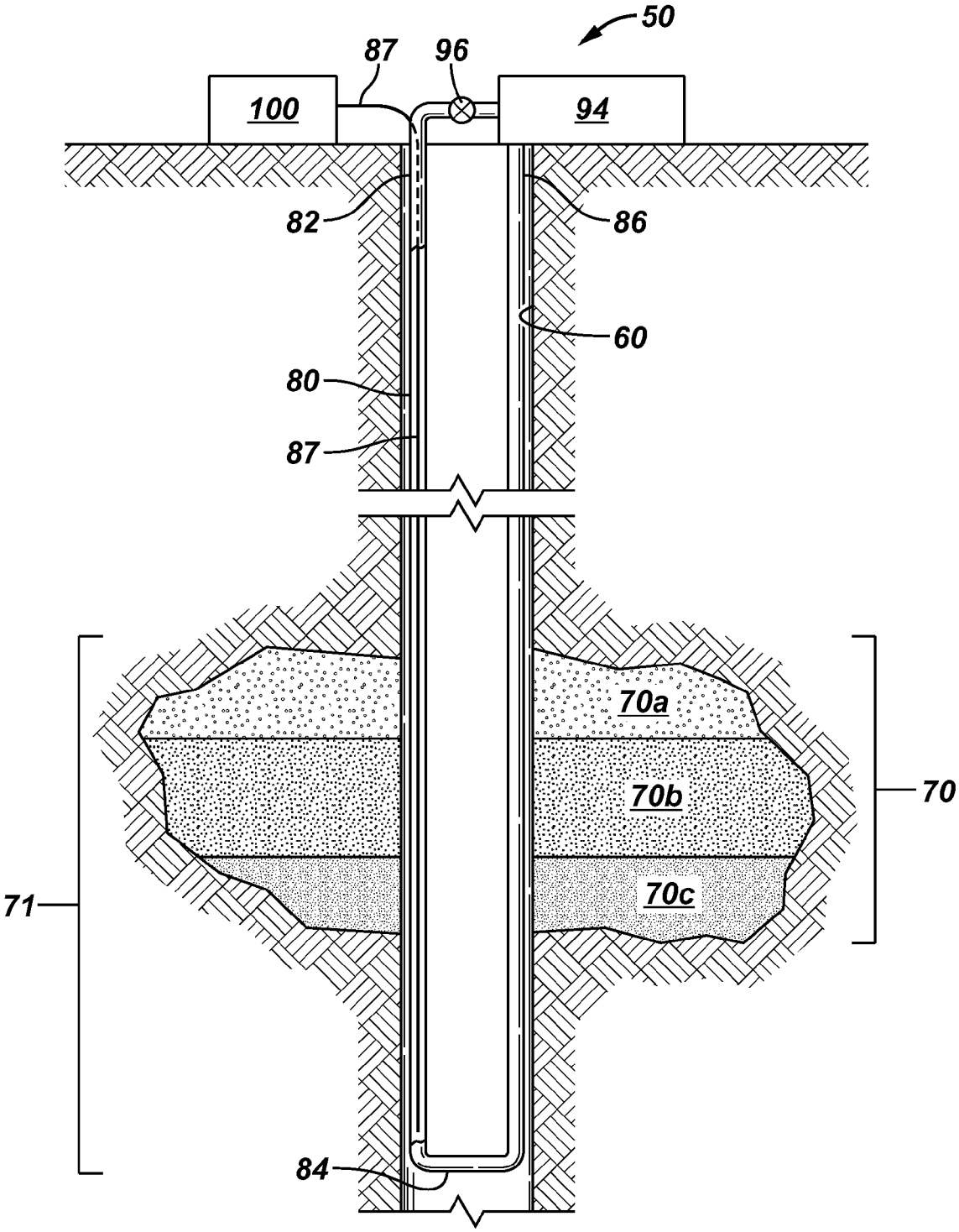
FIGS. 2, 10 and 13 are schematic diagrams of wells that have fluid level indication subsystems according to different embodiments of the invention.

FIG. 2 depicts an exemplary well 50, which uses a DTS-based system 100 (Sensa's DTS-800 system, for example), herein called the "distributed temperature sensor measurement system 100." For purposes of obtaining a temperature versus depth profile, the well 50 includes a downhole DTS subsystem, or fluid level indication subsystem, which includes a distributed temperature sensor 87 (an optical fiber, for example) that is disposed in a conduit 80 (a control line, as an example). In accordance with some embodiments of the invention, the distributed temperature sensor 87 may be placed inside a small diameter control line (not depicted in FIG. 2), which extends downhole inside the conduit 80. In this regard, the small diameter control line may be filled with an inert gas (nitrogen, for example) or fluid (silicone oil, for example) for purposes of protecting the distributed temperature sensor 87. More specifically, if the distributed temperature sensor 87 is an optical fiber, the fiber when placed in a fluid, such as water, may degrade relatively quickly. Therefore, by disposing the optical fiber inside a small diameter control line that extends inside the conduit 80 and filling this conduit with the inert gas, the lifetime of the optical fiber is extended.

The conduit 80 extends downhole in a wellbore 60 and traverses the region of interest 71, which contains various fluid layers 70 such as exemplary gas 70*a*, oil 70*b* and water 70*c* layers. As shown in FIG. 2, the conduit 80 is U-shaped in that the fluid flows through the conduit 80 downhole into the well 50 and returns uphole to the well surface. More specifically, the conduit 80 receives (at an inlet 82) a fluid flow, which is produced by a surface pump 96. The fluid flows from the inlet 82, through the fluid layers 70 and passes through a U-shaped bottom 84 of the conduit 80. At this point, the fluid returns to the surface of the well 50 and thus, passes through the layers 70 back to an outlet 86 of the conduit 80, which is located at the surface of the well. At the surface, the fluid enters a reservoir 94, and from the reservoir 94 the fluid returns via the pump 96 back into the well 50.

Thus, the conduit 80 forms a loop for circulating a fluid through the well fluid layers 70. Depending on the particular embodiment of the invention, the fluid in the conduit 80 may be water, toluene or hydraulic oil, as just a few examples.

In accordance with some embodiments of the invention, the sensor 87 may be retrievable from the well 50. For example, in embodiments of the invention, in which the sensor 87 is an optical fiber, the fiber may be pumped into position in the conduit 80. The overall physical condition of the optical fiber may potentially degrade over time. Therefore, it may become desirable to remove the optical fiber from the conduit 80 (by pumping) and pump a replacement optical fiber into the conduit 80.

It is noted that the well 50 is merely an example of one out of many different types of wells that may use the techniques and systems that are described herein. In this regard, although FIG. 2 depicts a vertical wellbore 60, it is understood that the systems and techniques that are described herein may be applied to deviated, lateral, or horizontal wellbore sections. Additionally, the wellbore 60 may be cased or uncased, depending on the particular embodiment of the invention. Furthermore, the well 50 may be a subterranean or subsea well, depending on the particular embodiment of the invention. Thus, many variations are contemplated, all of which fall within the scope of the appended claims.

The distributed temperature sensor 87 may be disposed in the downstream flowing portion of the conduit (as depicted in FIG. 2) or the upstream flowing portion of the conduit 80, depending on the particular embodiment of the invention. As another variation, in accordance with some embodiments of the invention, the distributed temperature sensor 87 of FIG. 2 may be installed in a double-ended configuration, in which the sensor 87 extends in a U configuration from the inlet 82 to the outlet 86 of the conduit 80. The distributed temperature sensor 87 may be deployed with the conduit 80 (and thus, may be installed downhole with the conduit 80) or may be subsequently pumped into the conduit 80 after the conduit 80 is installed downhole, depending on the particular embodiment of the invention. For embodiments of the invention in which the distributed temperature sensor 87 is an optical fiber, the sensor 87 may be optically coupled to a DTS measurement system 100, which may be located at the surface of the well 50.

By activating the pump 96, the temperature profile of the fluid in the loop (i.e., in the conduit 80) can be changed, as fluid from a region at one temperature is pumped to a region at a different temperature. When pumping ceases, the temperature of the fluid relaxes to the new local temperature. Since the efficiency of heat transfer is different for different fluids, the relaxation rates will differ from zone to zone. The distributed temperature profile will change with time and will have distinct regions that are separated by boundaries. These boundaries are located at the depths of the interfaces between the different fluids in the well.

Figure 3:
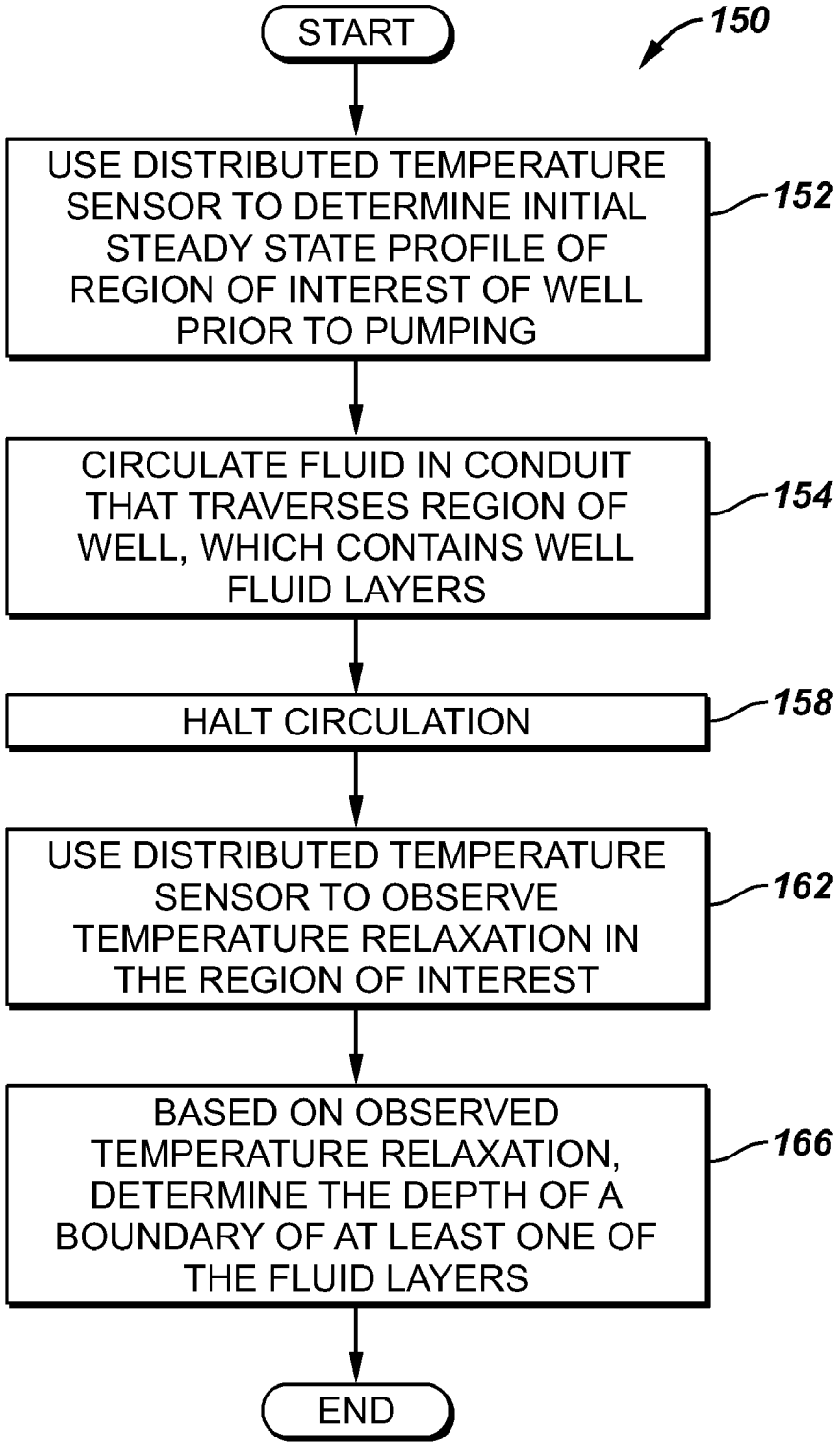
FIG. 3 is a flow diagram depicting a technique to determine the depth of at least one well fluid layer based on temperature relaxation according to an embodiment of the invention.

As a more specific example, FIG. 3 depicts a technique 150, which is an example of the relaxation test, in accordance with some embodiments of the invention. Pursuant to the technique 150, a distributed temperature sensor is used (block 152) to determine an initial steady state profile of region of interest prior to circulation of fluid. The fluid is circulated (block 154) in a conduit (e.g., the conduit 80 of FIG. 2), which traverses a region of the well that contains well fluid layers. Circulation of the fluid is then halted (block 158), e.g., the pump 96 is turned off. From this time, the temperature versus depth profile (as indicated by the DTS system) undergoes a temperature relaxation, in that the local temperature of the fluid in the conduit returns to the temperature of its surroundings at a rate that varies with the thermal properties (thermal capacity and thermal conductivity) of the surrounding environment.

Figure 4:
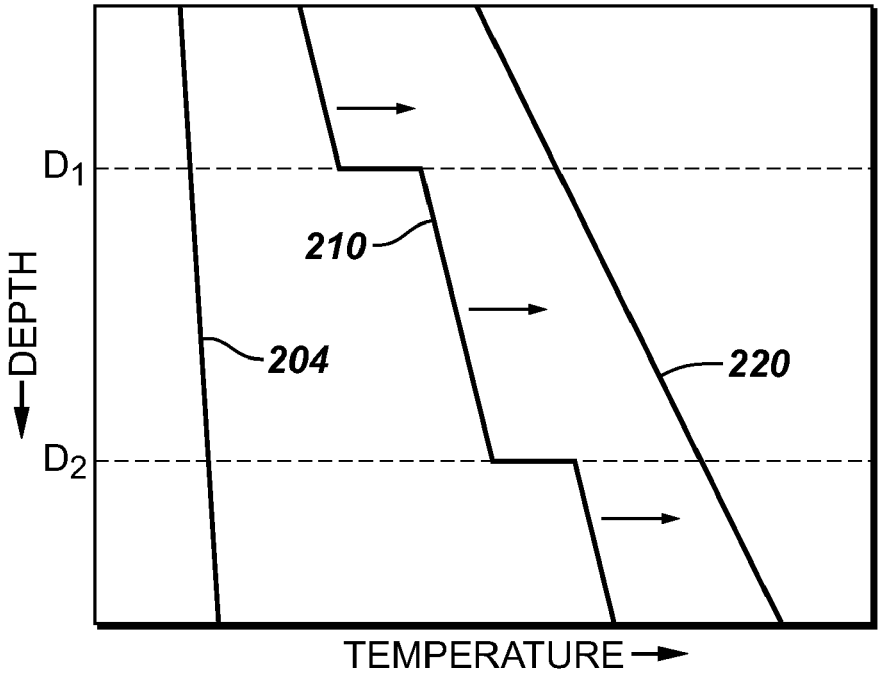
FIGS. 4 and 5 are illustrations of temperature versus depth profiles obtained by the distributed temperature sensor at different times according to different embodiments of the invention.

More specifically, FIG. 4 depicts an illustration 200 of three exemplary temperature versus depth profiles 204, 210 and 220, which are associated with different stages of the relaxation test. Prior to the pumping of fluid, the temperature versus depth profile is similar to the profile 220. While the fluid circulates in the conduit 80 (FIG. 2) at a sufficiently fast rate, the temperature versus depth profile resembles the exemplary profile 204, which is generally linear. After the pump is turned off, the relatively cool fluid is heated by the surrounding fluid layers, thereby changing the temperature versus depth profile, as the local temperatures rise. Because the well fluid layers 70 have different thermal conductivities and capacities, the rate of warming is locally different in the different layers 70 during the warming, or relaxation period, as illustrated by exemplary profile 210.

Due to the differences in the thermal properties, the profile 210 is discontinuous at each well fluid layer interface. Thus, the boundary between the upper gas layer 70*a* and the middle oil layer 70*b*, according to the temperature profile 210, occurs at depth $D_1$; and the interface between the middle oil layer 70*b* and the lower water layer 70*c* occurs at a depth $D_2$. The arrows adjacent the profile 210 indicate the direction that the profile 210 moves over time.

Eventually, the transient effects, which are present during the relaxation period, pass so that the fluid in the loop warms up to the temperature of the surrounding fluid. At this point, the temperature versus depth profile resembles the exemplary profile 220, which is generally linear throughout all of the well fluid layers 70 and represents the geothermal gradient (unless secondary tertiary recovery schemes such as steam flooding is used in which case the profile is not linear). When thermal equilibrium around the loop has been established, the above-described process may be repeated. Several relaxation temperature versus depth profiles may be stacked for purposes of improving the overall signal-to-noise ratio. The stacking of successive relaxation profiles is valid because the fluid levels in a well may vary relatively slowly with time.

Many variations are contemplated and are within the scope of the appended claims. For example, in accordance with other embodiments of the invention, the well may not have a reservoir at the surface for purposes of storing the fluid that is circulated through the conduit 80. In this regard, instead of pumping relatively colder fluid from the surface of the well, relatively warmer fluid may be pumped through the loop across the reservoir. The warmer fluid may also be supplied, for example, by a surface heating system or from a downhole pump. Thus, with circulation of the fluid through the loop being halted, the local temperature of the fluid cools (instead of being heated) as a function of the thermal conductivities and capacities of the surrounding fluid layers.

Figure 5:
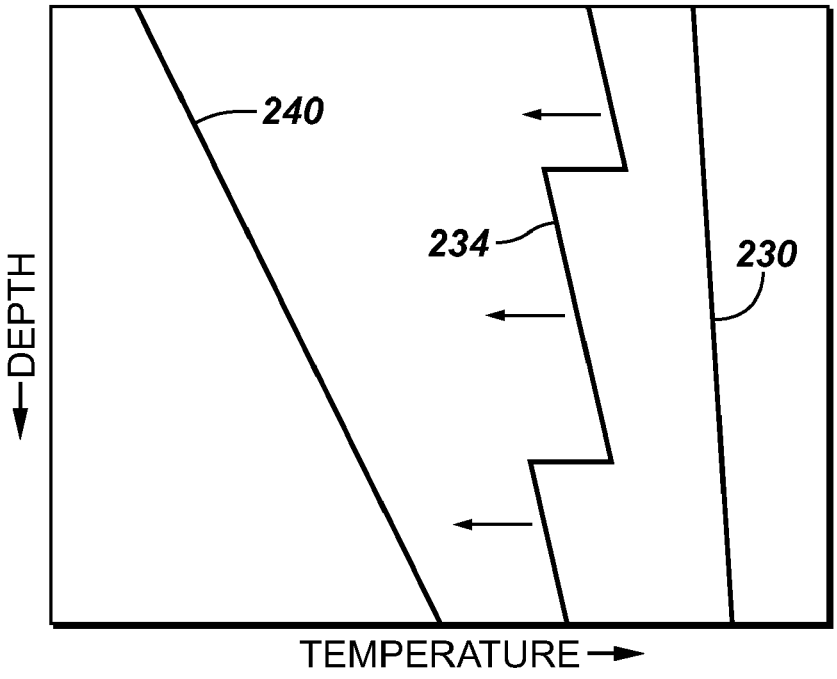

As a more specific example, FIG. 5 depicts an illustration 229 of exemplary temperature versus depth profiles 230, 234 and 240, which are associated with the fluid circulation, no fluid flow and end of relaxation stages, respectively, when the warmer fluid is circulated, in accordance with some embodiments of the invention. As shown, when the pumping first ceases, the temperature versus depth profile resembles the exemplary generally linear profile 230. During the relaxation, the localized fluid temperature is a function of the thermal properties of the local environment; and as such, the temperature versus depth profile resembles the exemplary profile 234, which has discontinuities that identify the well fluid interfaces. Eventually at the end of the relaxation, the temperature versus depth profile transitions to the exemplary profile 240, which is generally linear.

It is noted that the systems that are described herein may be used in applications in which steam is pumped into the reservoir to reduce the viscosity of the oil. In this case, the initial temperature versus depth profile may not be linear but instead may exhibit an increase in temperature higher up in the well. Nevertheless, a change in temperature on pumping the fluid and a relaxation to the initial profile are still revealed. Irrespective of the initial profile, the local rate of relaxation is dependent on the thermal properties of the well fluid at the particular depth.

The relaxation of the local temperature measured by DTS depends on the local thermal conductivity (k) and the specific heat capacity (cp) of the material surrounding the conduit in which the sensor is contained. Faster relaxation occurs with higher thermal conductivity and higher specific heat capacity of the surrounding material; and therefore, in an approximation, the relaxation time decreases with their product (k*cp). Table 1 depicts typical values of thermal conductivity (k), specific heat capacity (cp) and their product (k*cp) for water, typical oil, methane, steam and air.

TABLE 1

| | Water | Oil | Methane | Steam | Air |
|---|---|---|---|---|---|
| Specific Heat capacity (cp) J · g−1 · K−1 | 4.18 | 1.6-2.4 | 2.2-2.8 | 2 | 1.01 |
| Average cp J · g−1 · K−1 | 4.18 | 2 | 2.5 | 2 | 1.01 |
| Thermal Conductivity (k) W · K−1 · m−1 | 0.55-0.67 | 0.15 | 0.03 | 0.016 | 0.024 |
| Average k W · K−1 · m−1 | 0.61 | 0.15 | 0.03 | 0.016 | 0.024 |
| Product (average cp) * (average k) | 2.55 | 0.3 | 0.075 | 0.032 | 0.024 |

The product k*cp is approximately an order of magnitude higher for water than for oil, which in turn is almost an order of magnitude higher than for any of the gases (methane, steam, air). This indicates that the location of the oil/water and gas/oil fluid interfaces in a well may be identified by changes or discontinuities in relaxation of the temperature versus depth profile after pumping hotter or colder fluid across the reservoir.

Figure 6:
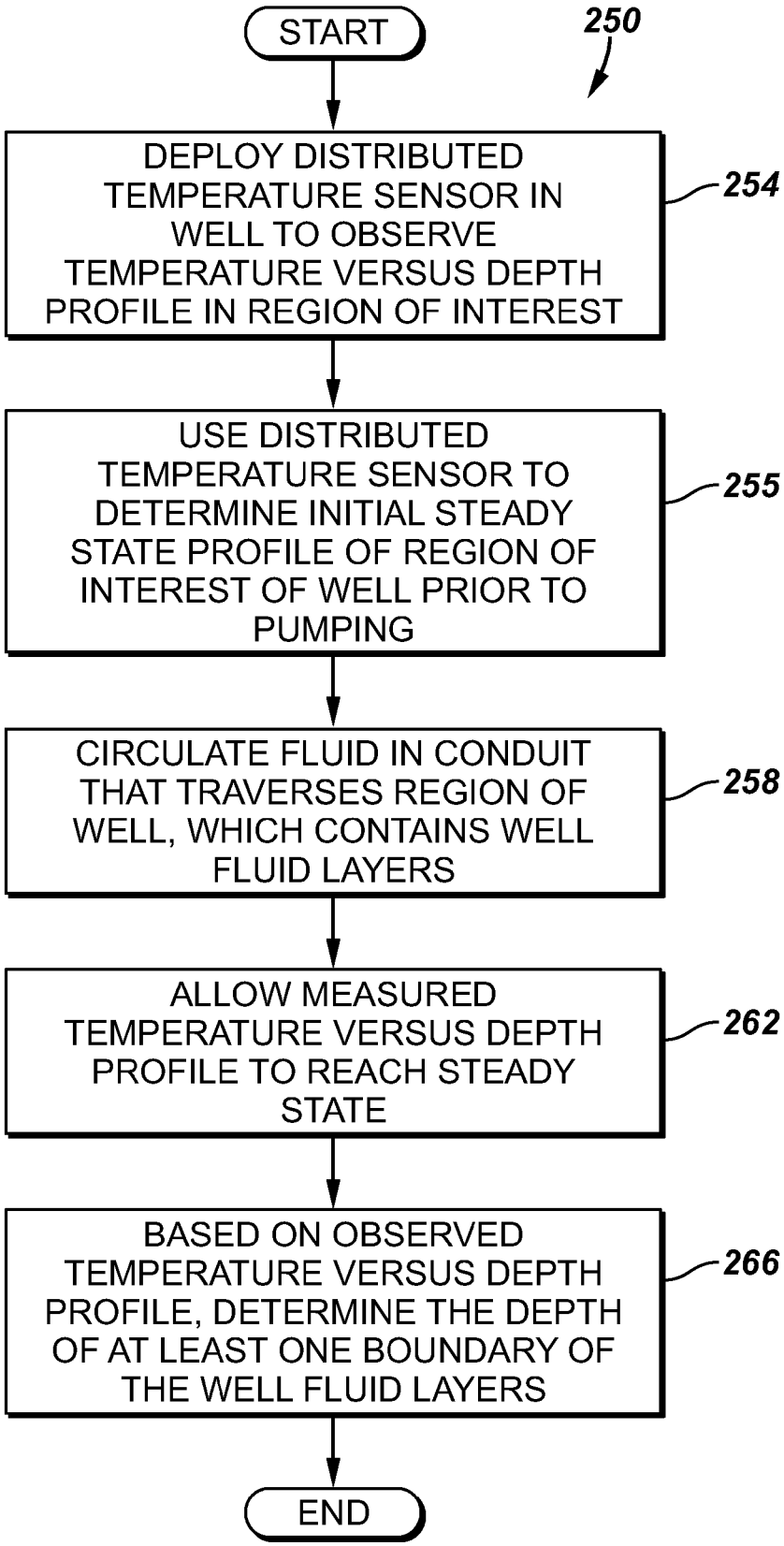
FIG. 6 is a flow diagram depicting a technique to use a distributed temperature sensor to determine the depth of a boundary of at least one well fluid layer using a steady state temperature measurement technique according to an embodiment of the invention.

FIG. 6 depicts a steady state technique 250 in accordance with an embodiment of the invention and may be used as an alternative to the relaxation test or may be used in conjunction with the relaxation test, as further described below. Unlike the relaxation test, the steady state test involves taking a DTS measurement while the fluid is circulating in the conduit 80. The rate at which the fluid is being circulated in the conduit 80 (FIG. 2) is such that the observed temperature versus depth profile contains discontinuities at the well fluid interfaces. More specifically, pursuant to the technique 250, a distributed temperature sensor is deployed (block 254) in a well to observe a temperature versus depth profile in a region of interest. A distributed temperature sensor is used (block 255) to determine an initial steady state profile prior to the circulation of a fluid in the conduit that contains the sensor. The fluid is then circulated through a conduit that traverses a region of the well, which contains well fluid layers, pursuant to block 258. The temperature versus depth profile is then allowed to reach steady state, pursuant to block 262. Based on the observed temperature versus depth profile, the depth of at least one well fluid layer interface is determined, pursuant to block 266.

Thus, instead of pumping fluid from a hotter or colder zone and then stopping and measuring the temperature relaxation, the pumping may instead be continuous. The temperature versus depth profile in the loop reaches steady state when the local flow of heat into and out of the loop is balanced. At steady state, there is a discontinuity in the temperature versus depth profile for each point where the loop crosses the boundary between two fluid layers.

The advantages of the steady state test may include one or more of the following, depending on the particular embodiment of the invention. The steady state test allows data to be recorded over a longer period; and the data may be stacked and averaged over time, thereby giving greater temperature resolution and greater sensitivity. This steady state test may possibly be easier to automate than the relaxation test. The steady state test may provide a more reliable identification of the interface depths when there is a non-uniform temperature distribution with depth, such as, for example, in steam flood wells where a hot gas layer may overlay cooler oil and water zones. If there are conduction effects in the loop, which may degrade the DTS measurement, the steady state approach may be less susceptible to this degradation.

Figure 7:
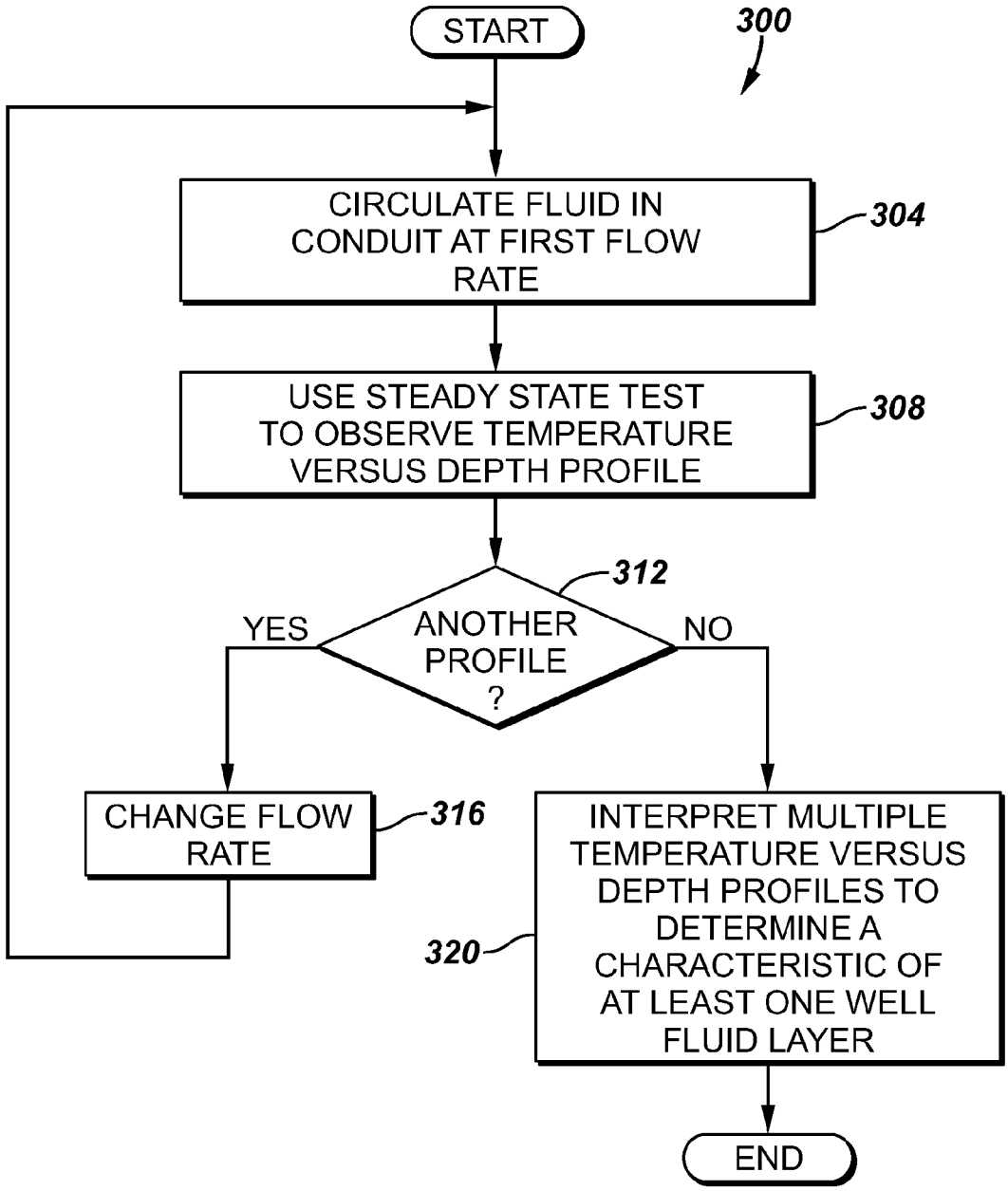
FIG. 7 is a flow diagram depicting a technique to determine the depth of at least one well fluid layer boundary using a combination of distributed temperature sensing and different flow rates according to an embodiment of the invention.

Referring to FIG. 7, variations of the above-described steady state test may be performed in other embodiments of the invention. For example, several steady state tests may be performed, where a different circulation flow rate is used for each test. Thus, pursuant to a technique 300, fluid may be circulated in a conduit at a first flow rate (block 304), and the steady state test may be used to obtain a corresponding temperature versus depth profile, pursuant to block 308. If another profile is desired (diamond 312), the flow rate is changed (block 316) before the steady state test is used again to observe a corresponding temperature versus depth profile, pursuant to block 308. After several temperature versus depth profiles have been obtained, the temperature versus depth profiles may be interpreted (block 320) to determine the depth of at least one well fluid layer interface. The generation of multiple temperature versus depth profiles may provide a better interpretation of the positioning of the well fluid layers and the corresponding interfaces.

Figure 8:
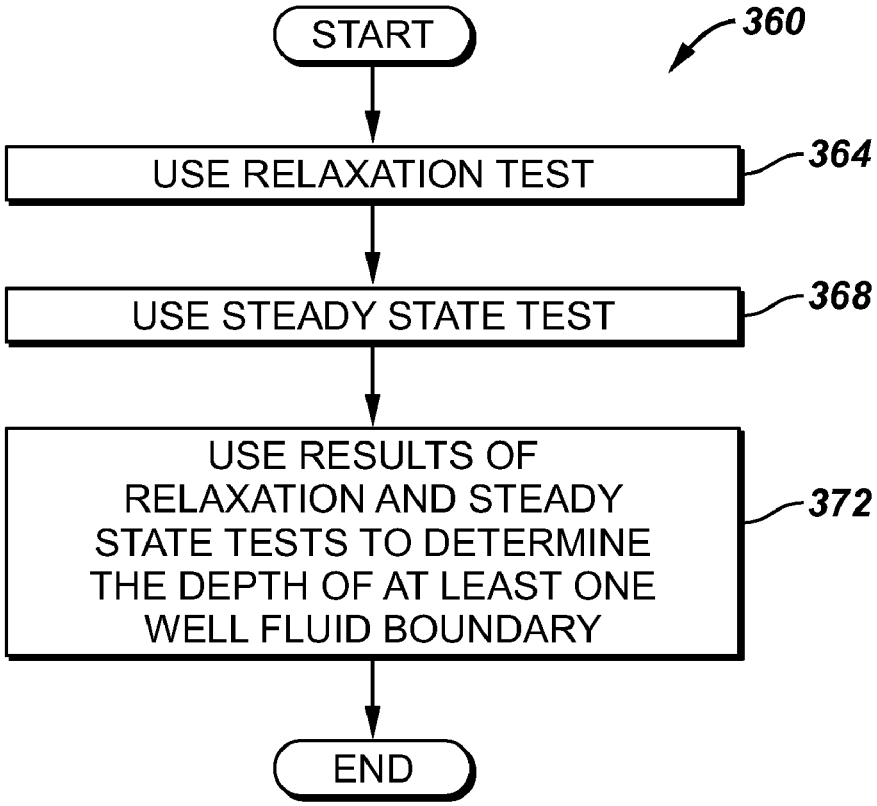
FIG. 8 is a flow diagram depicting a technique to use a combination of relaxation and steady state distributed temperature sensing techniques to determine the depth of at least one well fluid layer boundary according to an embodiment of the invention.

As an example of another embodiment of the invention, referring to FIG. 8, a technique 360 may include using both the relaxation (block 364) and steady state (block 368) tests to determine the depth of at least one well fluid interface. Results of the relaxation and steady state tests may then be combined to identify one or more of the characteristics, pursuant to block 372. Depending on the geometry and the nature of the fluid and materials, the determination of different fluid interfaces may be more sensitive to one test than to the other. Thus, by using the combination of the steady state and relaxation tests, as outlined in FIG. 8, the positioning of the well fluid layers and interfaces may be more accurately determined.

In fields where steam flooding is employed, a layer of fresh water may be produced from condensed saline formation water. Thus, there may be in effect, a fourth fluid layer. Knowledge of the position of this layer may be useful. However, determining the boundaries of the fresh and saline water layers may be more difficult than the determination of the other boundaries because the fresh and saline water have very similar thermal conductivities and thermal capacities. Therefore, the use of a more sensitive technique (such as the technique 300 (FIG. 7), for example) may be able to distinguish the fresh and saline layers and the interface in between.

Figure 9:
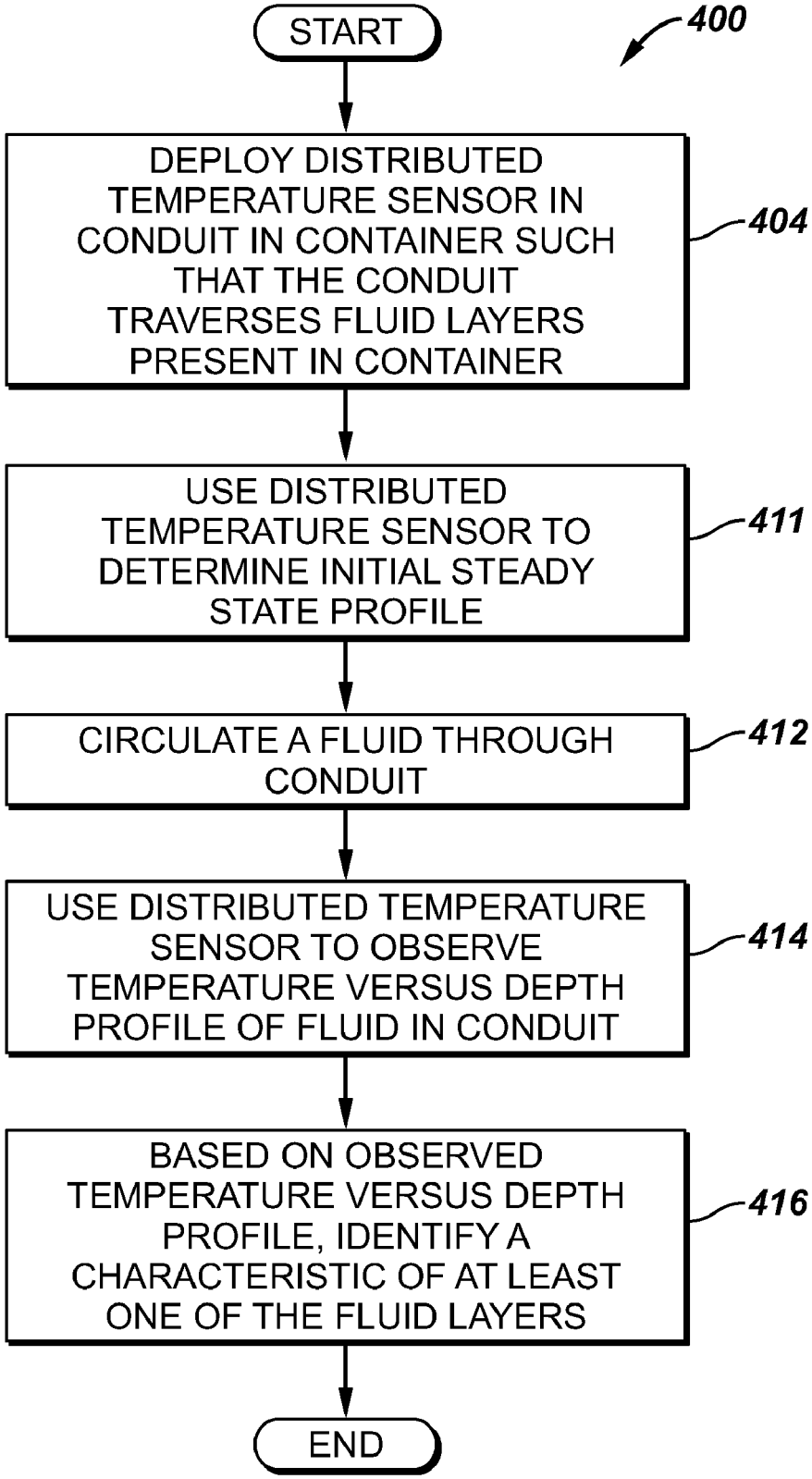
FIG. 9 is a flow diagram depicting a technique to use a distributed temperature sensor to identify a characteristic of at least one fluid layer that is present in a container according to an embodiment of the invention.

Other systems and techniques are contemplated and are within the scope of the appended claims. For example, referring to FIG. 9, a technique 400 in accordance with some embodiments of the invention includes deploying a distributed temperature sensor in a container inside a conduit that extends through fluid layers present in the container, pursuant to block 404. The distributed temperature sensor is used (block 413) to determine the initial steady state profile prior to the circulation of a fluid that is contained in the conduit. The fluid is then communicated (forced through by a pump, for example) through the conduit, pursuant to block 412; and the distributed temperature sensor is used to observe a temperature profile of fluid in the conduit, pursuant to block 414. Thus, the particular profile observed depends on whether the relaxation test, the steady state test or a combination thereof is used. Based on the observed temperature profile, a characteristic of at least one of the fluid layers is identified, pursuant to block 416.

As another variation, in accordance with some embodiments of the invention, the DTS system described herein may be combined with other downhole sensor-based subsystems. In this regard, in accordance with some embodiments of the invention, one or more pressure sensors (as an example) may be disposed downhole in the well to measure pressure(s) of the well fluid layer(s).

In general, using fluid circulation alone to change the local temperature of the distributed temperature sensor may present challenges relating determining the exact rate of heat transfer at each point, which complicates the process of estimating the surrounding fluid properties and determining the fluid boundary interfaces. Additionally, the variation of temperature along the conduit may be too small for a practicable rate of fluid circulation to induce measurably large rates of heating or cooling at all regions of interest along the distributed temperature sensor. Therefore, as described below, in accordance with embodiments of the invention, techniques and systems may be employed to increase the achievable range of temperature variations above those of the ambient environment, for the purposes of providing more accurate fluid level indications.

As a more specific example, a downhole heating element may be used in connection with the circulating fluid for purposes of introducing a larger temperature change in the local environment of the distributed temperature sensor. In this regard, referring to FIG. 10, in accordance with another embodiment of the invention, a well 450 includes a fluid level indication system that is similar to the fluid level indication system of FIG. 2 (with like reference numerals being used to denote similar components), except that the fluid level detection system of FIG. 10 includes a downhole heater 460, which may be powered, for example, by a surface electrical power source 452.

The heater 460 is positioned (circumscribes the conduit 80, for example) to heat the fluid in the conduit 80 in response to the power source 452 energizing (i.e., communicating electrical power to) the heater 460. The distributed temperature sensor 87 traverses the region of interest 71, and thus, the well fluid layers 70. The pump 96 is operated to circulate fluid from the fluid reservoir 94 through the conduit 80, and the electrical power source 452 is activated to deliver electrical power through electrical communication lines 456 to the downhole heater 460. The electrical heater 460 heats the circulating fluid as the fluid passes near the heater 460, thereby inducing temperature changes in the local environment of the distributed temperature sensor 87 in the region of interest 71.

It is noted that, depending on the particular embodiment of the invention, the heater 460 may be energized intermittently while the fluid circulation remains continuous; the heater 460 may be continuously energized while the pump 96 runs intermittently; or the heat 460 and the pump 96 may be both operated intermittently. Thus, many variations are contemplated and are within the scope of the appended claims.

The relative position of the heater 460 with respect to the region of interest 71 may be chosen to suit the thermal conditions in the well 450. More specifically, the heater 460 may be placed in a part of the well 450 where the ambient temperature is greater than the temperature in the region of interest 71, so that the thermal energy that is contributed by the heater 460 aids the local heating arising from the fluid circulation from a hotter part of the well 450 to a cooler part of the well 450.

Figure 10:
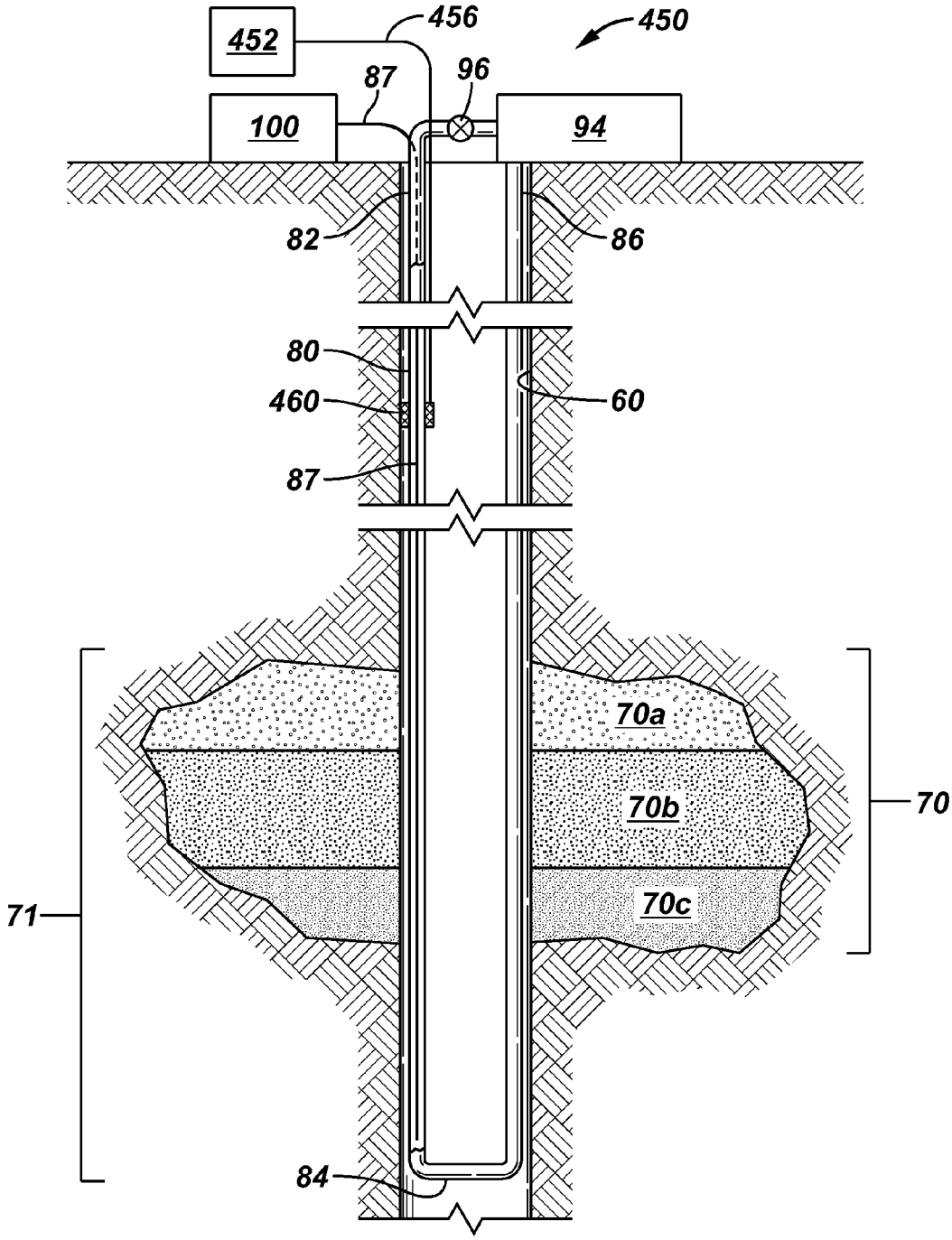

For the arrangement that is depicted in FIG. 10, it is assumed that the upper part of the well 450 is hotter than the lower part, such as a condition that may arise from steam heating. Thus, the fluid is communicated from the fluid reservoir 94, passes through the heater 460, raises the temperature in the region of interest 71 and then returns to the reservoir 94. Alternatively, if the lower part of the well is hotter, the heater 460 may be placed below the region of interest 71, and the direction of fluid circulation may be reversed.

If the thermal conditions in the well 450 are known to be subject to change, two or more heaters may be installed at different locations to suit each mode of operation. As a more specific example, the well 450 may be switched between injection and production modes, and thus, the electrical heating and fluid circulation directions are varied, depending on whether the well 450 is in the injection mode or in the production mode.

The depths of one or more of the well fluid interfaces may be determined based on the response of the distributed temperature sensor 87 to the heating of the fluid, using the relaxation technique, the steady state technique or a combination of these techniques, as described above.

Figure 11:
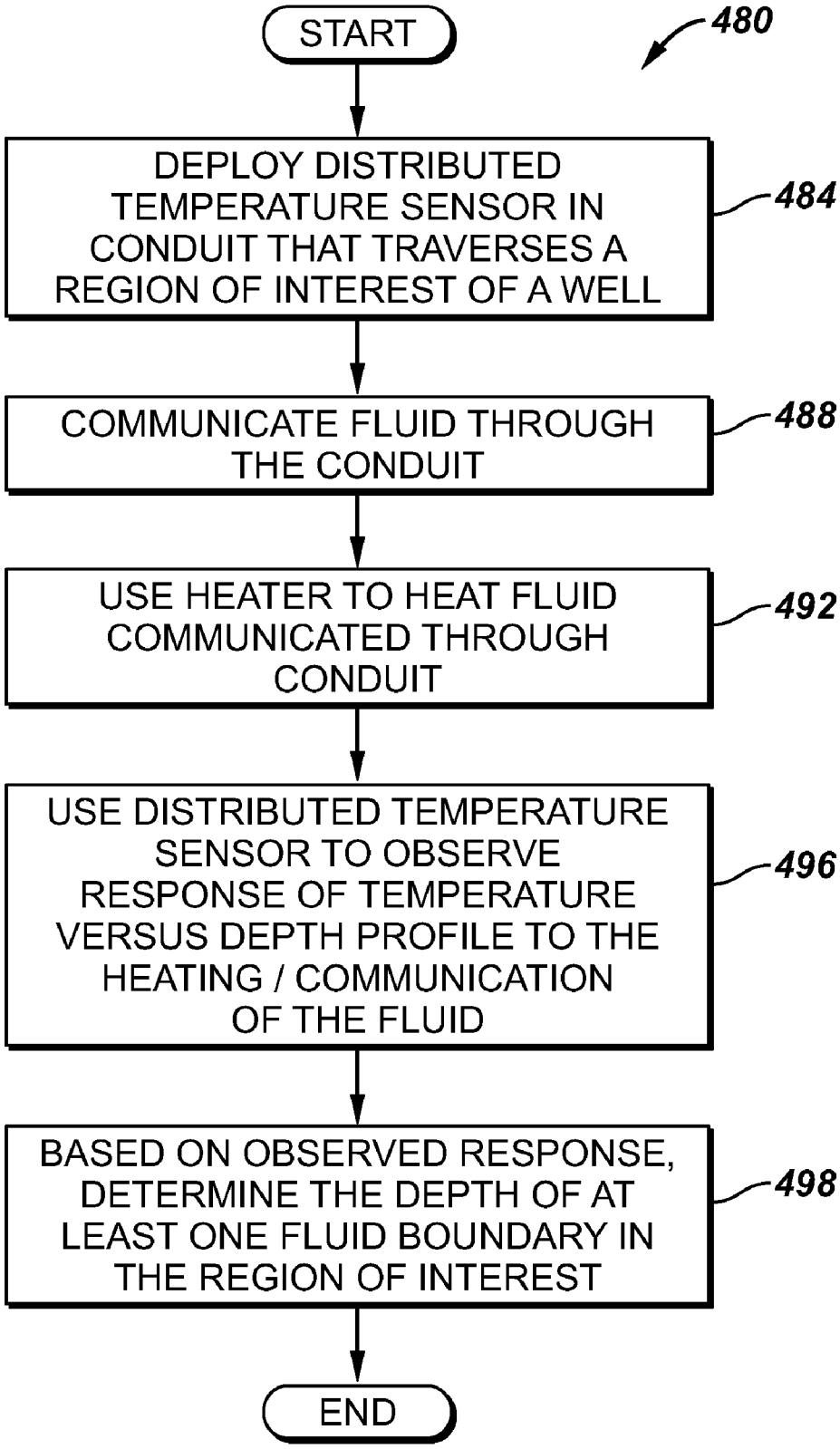
FIGS. 11 and 12 are flow diagrams depicting techniques that heat the local environment sensed by a distributed temperature sensor for purposes of determining the depth of a boundary of at least one well fluid layer according to embodiments of the invention.

Thus, to summarize, a technique 480, which is depicted in FIG. 11, may be used in accordance with some embodiments of the invention to determine the depth of at least one fluid boundary in the region of interest 71. Pursuant to the technique 480, a distributed temperature sensor is deployed (block 484) in a conduit that traverses a region of interest of the well, and fluid is communicated through the conduit, pursuant to block 488. A heater is used, pursuant to block 492, to heat the fluid that is communicated through the conduit, and the distributed temperature is used (block 496) to observe the response of the temperature versus depth profile measured by the temperature sensor to the heating/communication of the fluid. Based on the observed response, the depth of at least one fluid boundary in the region of interest is determined, pursuant to block 498.

Figure 12:
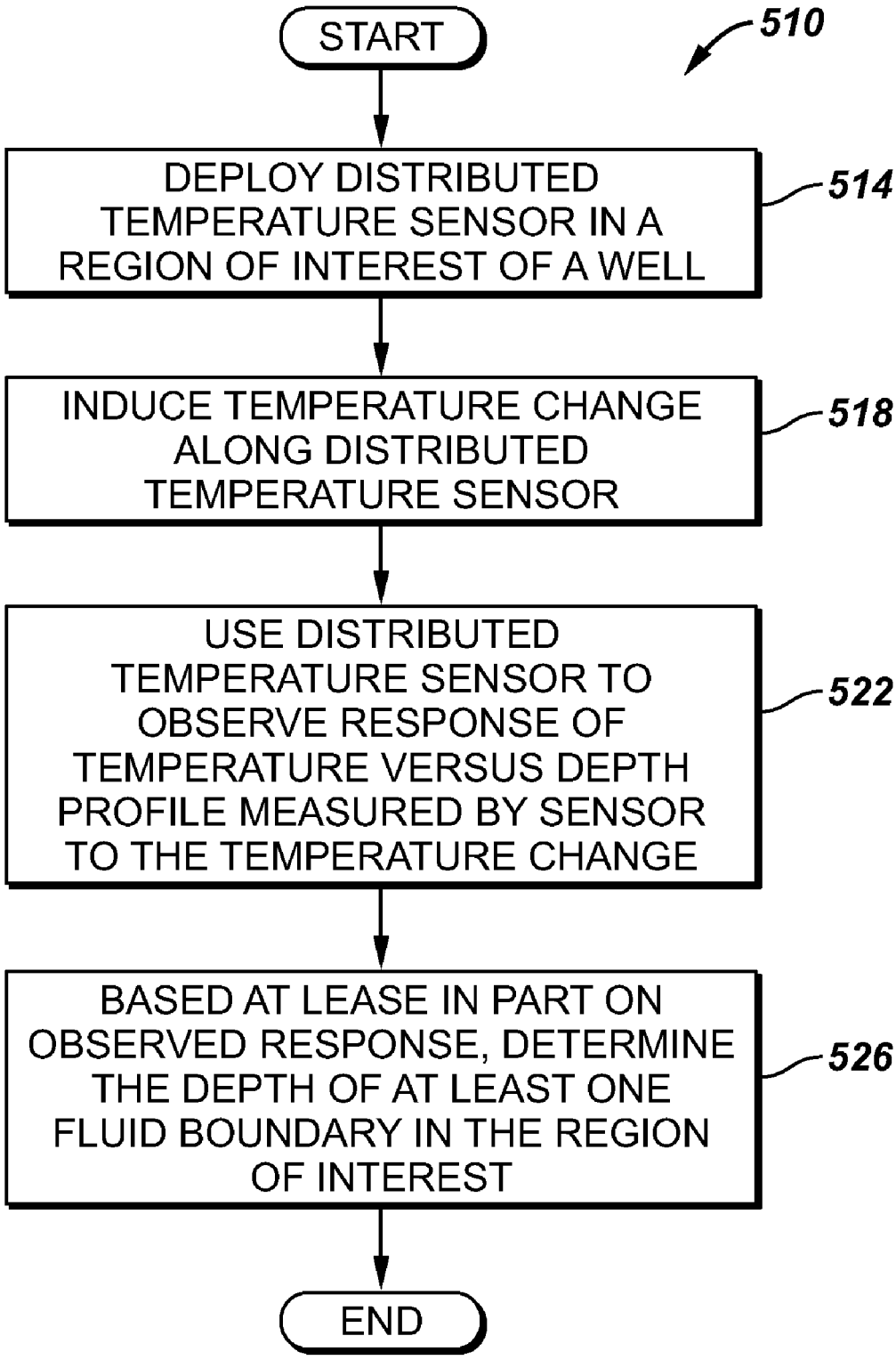

The above-described techniques of fluid circulation and fluid heating are at least two different ways that may be used independently or together to induce a temperature change in the local environment of the distributed temperature sensor. Therefore, in general, a technique 510 (see FIG. 12) in accordance with embodiments of the invention includes deploying a distributed temperature sensor in a region of interest of a well, pursuant to block 514. A temperature change is induced along the distributed temperature sensor (e.g., by fluid circulation and/or heating of the fluid), pursuant to block 518. The distributed temperature sensor is used (block 522) to observe a response of a temperature versus depth profile measured by the sensor to the temperature change, pursuant to block 522; and based at least in part on the observed response, the depth of at least one fluid boundary in the region of interest is determined, pursuant to block 526.

Figure 13:
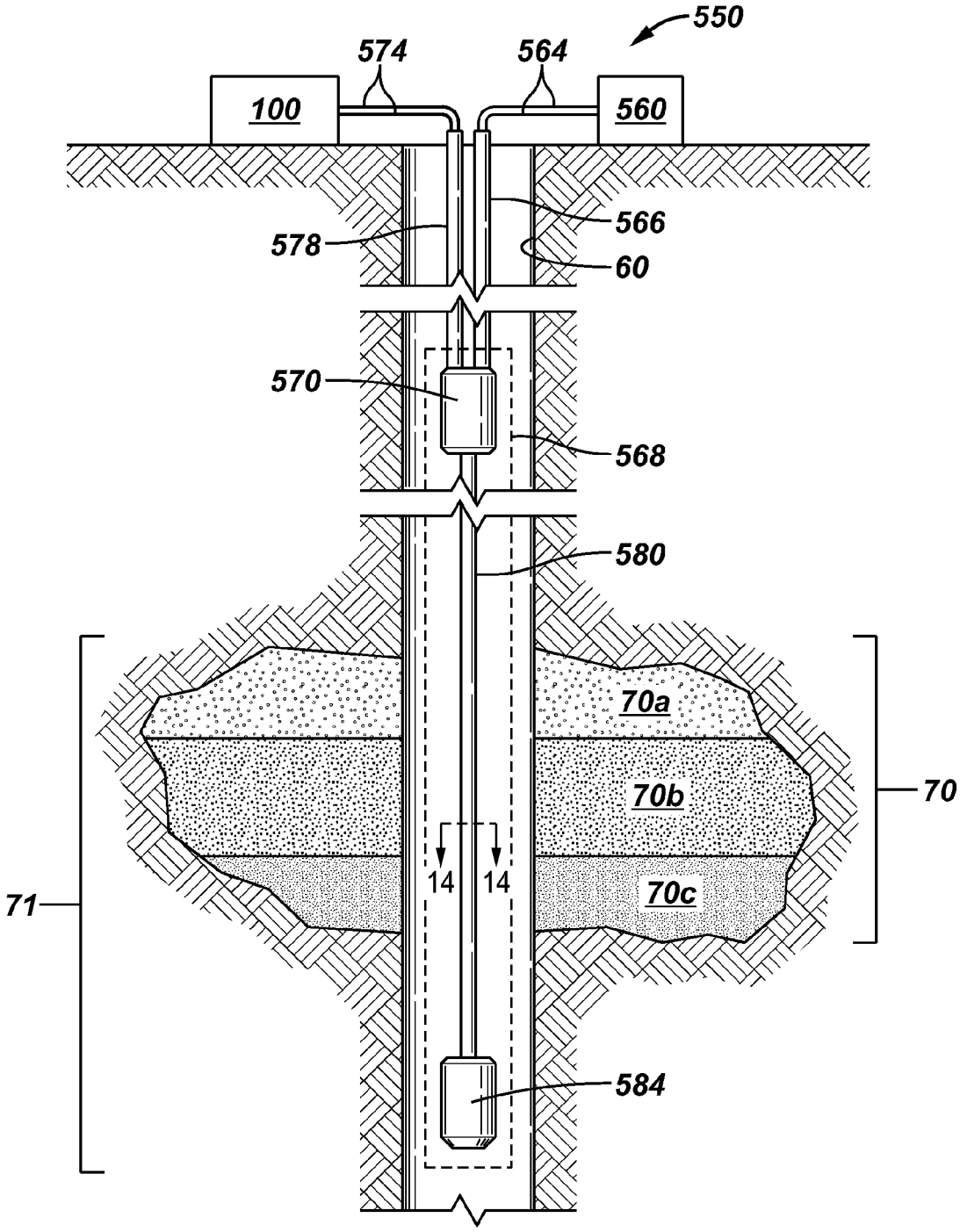

In accordance with other embodiments of the invention, other systems and techniques may be used to heat the local environment of the distributed temperature sensor without directly exposing the distributed temperature sensor to fluids, which may potentially degrade the sensor over time. In this regard, FIG. 13 depicts a well 550, in accordance with some embodiments of the invention. Certain components of the well 550 are similar to the components of the well 50 (FIG. 2) and are therefore denoted by like reference numerals. Unlike the well 50, however, the well 550 includes a fluid level indication subsystem 568, which includes a sensor cable 580 that, in turn, includes an encapsulated distributed temperature sensor. In general, the sensor cable 580 is constructed to traverse the region of interest 71, and the sensor cable 580 contains a built-in heater to selectively heat the distributed temperature sensor so that the response to the temperature change may be observed to determine the depths of the well fluid interfaces.

More specifically, the sensor cable 580 connects upper 570 and lower 584 sub assemblies of the fluid level indication subsystem 568. In general, the sensor cable 580 longitudinally traverses the region of interest 71, where several fluid interfaces are expected, such as interfaces between the gas 70*a*, oil 70*b* and water 70*c* layers.

Figure 14:
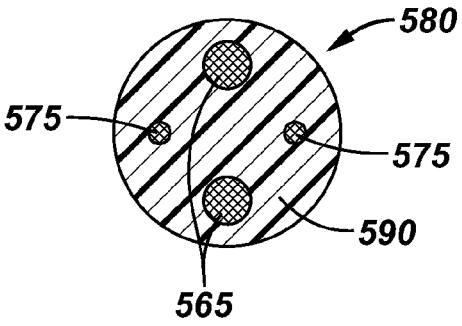
FIG. 14 is a cross-sectional view taken along line 14-14 of FIG. 13 according to an embodiment of the invention.

Referring to FIG. 14 in conjunction with FIG. 13, in accordance with some embodiments of the invention, the sensor cable 580 includes two longitudinally extending optical fibers 575 and two longitudinally extending resistive heating elements 565, which may be, as an example, electrical wires that have relatively high electrical resistances. As an example, the sensor cable 580 may include a dielectric material 590 which encapsulates the optical fibers 575 and heating elements 565. The sensor cable 580 may be protected by an outer sheath (not shown), which protects the components of the cable 580 (such as the optical fibers 575 and heating elements 565) from the well environment.

Figure 15:
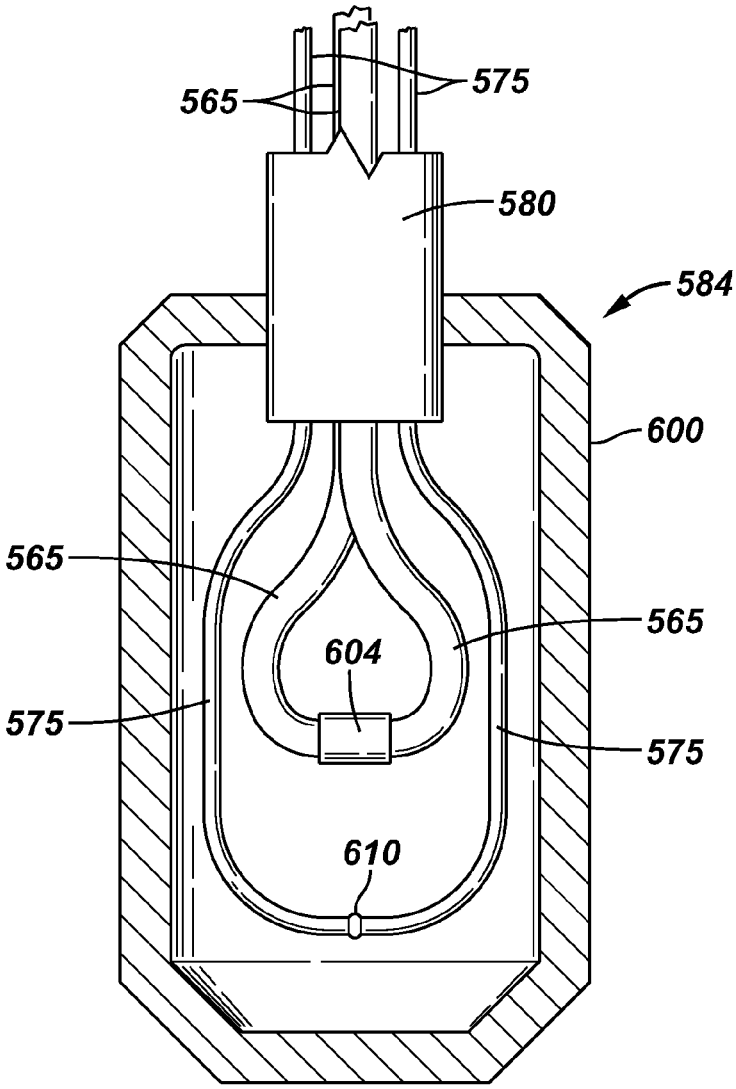
FIG. 15 is a cross-sectional view of a lower sub assembly of FIG. 13 according to an embodiment of the invention.

Referring to FIG. 15 in conjunction with FIG. 13, the lower sub assembly 584 optically and electrically connects the optical fibers 575 and heating elements 565 at the bottom of the fluid level indication subsystem 580. More specifically, the lower sub assembly 584 includes a pressure housing 600, which provides environmental protection for the optical and electrical connections. Furthermore, the lower sub assembly 584 may serve as a weight to aid in extending the sensor cable 580 across the region of interest 71. As depicted in FIG. 15, inside the pressure housing 600, the optical fibers 575 may be connected together at their lower ends by an optical splice 610; and the heating elements 565 may be connected together at their lower ends by an electrical connector 604.

Referring to FIG. 13, inside the upper sub assembly 570, the two optical fibers 575 of the sensor cable 580 are spliced to a second pair of optical fibers 574, which are part of a lead in/lead out cable 578 that extends to the distributed temperature sensor measurement system 100 at the surface. Likewise, inside the upper sub assembly 570, the heating elements 565 of the sensor cable 580 are spliced to a pair of electrical conductors 564 of a lead in/lead out cable 566 that extends to a surface located electrical power source 560.

Due to the above-described optical and electrical connections, an optical loop is formed, which creates at least one distributed temperature sensor. The optical loop begins at the distributed temperature system 100, extends downhole through one of the optical fibers 574 of the cable 578, and extends downhole through one optical fiber 575 of the sensor cable 580 to the midpoint of the loop, which is located at the lower sub assembly 584. From the lower sub assembly 584, the optical loop extends upwardly through the other optical fiber 575 of the sensor cable 580 and returns via the other optical fiber 574 of the cable 578 to the surface to connect to the distributed temperature measurement system 100.

Likewise, an electrically resistive heating loop is created to communicate a current when the electrical power source 560 is activated. The heating loop extends downhole from the electrical power source 560, through one of the electrical conductors 564 of the cable 566, through one heating element 565 of the sensor cable 580, and has its midpoint at the lower sub assembly 584. From the midpoint of the lower sub assembly 584, the heating loop extends uphole through the other heating element 565 of the sensor cable 580 and returns via the other electrical conductor 564 of the cable 566 to the surface to connect to the electrical power source 560.

The electrical power source 560 may be operated either continuously or intermittently to communicate a current through the heating elements 565 of the sensor cable 580. Because the heating elements 565 have higher resistances than the electrical conductors 564 of the cable 566, a significant portion of the power that is delivered by the electrical power source 560 is transferred into heat in the sensing cable 580 and thus, heats the local environment of the distributed temperature sensor.

If the resistance per unit length of the heating element 565 is substantially constant, then the heat input per unit length along the sensor cable 580 is also substantially constant. The distributed temperature sensor(s) (created by the optical fibers 575) measure the response of the surrounding medium to the intermediate or continuous heat input.

Many variations are contemplated and are within the scope of the appended claims. For example, in accordance with other embodiments of the invention, the lower sub assembly 584 does not splice the lower ends of the optical fibers 575 together, but instead, the sensor cable 580 contains one or possibly two single-ended mode distributed temperature sensors.

Figure 17:
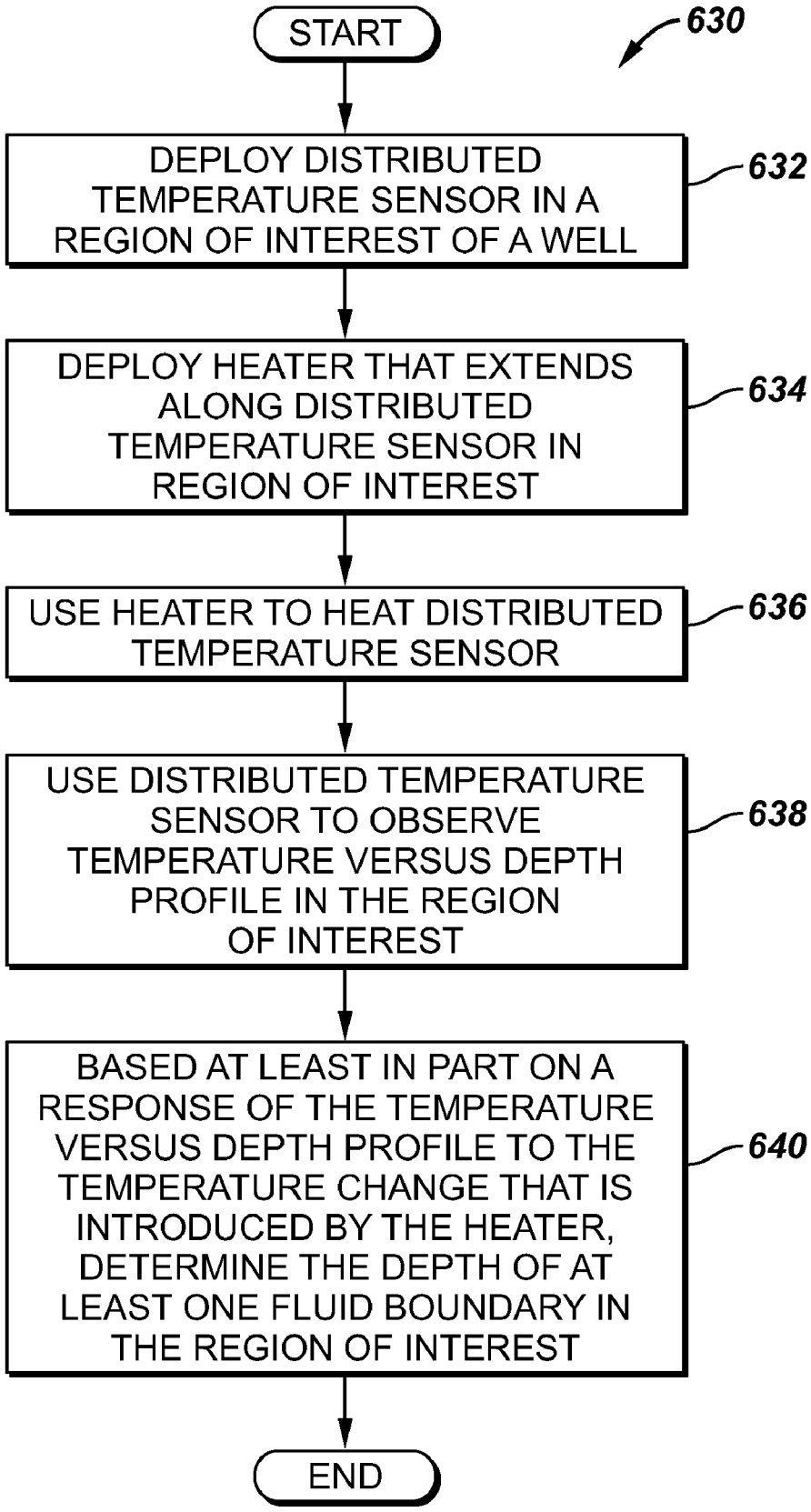
FIG. 17 is a flow diagram depicting a technique to use a heating element to heat a distributed temperature sensor along its length and determine the depth of at least one well fluid layer boundary based on a response of the distributed temperature sensor to the heating according to an embodiment of the invention.

Regardless of whether a single-ended distributed temperature sensor, double-ended distributed temperature sensor, a single distributed temperature sensor or multiple distributed temperature sensors are used as part of the sensor cable 580, a technique 630, which is depicted in FIG. 17, may be used in accordance with some embodiments of the invention. Pursuant to the technique 630, a distributed temperature sensor (i.e., at least one distributed temperature sensor) is deployed in a region of interest of a well, pursuant to block 632. A heater is also deployed, which extends along the distributed temperature sensor in the region of interest, pursuant to block 634. The heater is used (block 636) to heat the distributed temperature sensor, and the distributed temperature sensor is used (block 638) to observe a temperature versus depth profile in the region of interest, pursuant to block 638. Based at least in part on a response of the temperature versus depth profile to the temperature change that is introduced by the heater, the depth of at least one fluid boundary in the region of interest is determined, pursuant to block 640. Thus, the relaxation technique, the steady state technique, or a combination of these techniques may be used to determine the fluid interface depth(s), as described above.

Figure 16:
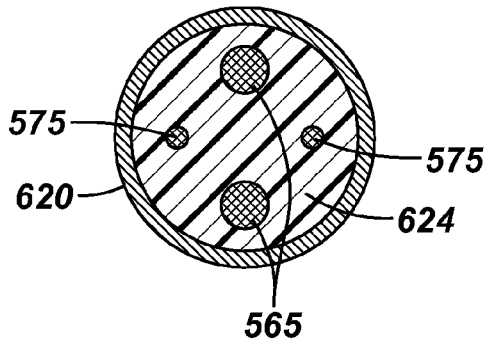
FIG. 16 is a cross-sectional view of a conduit that contains a distributed temperature sensor and a heating element according to an embodiment of the invention.

It is noted that the heating element may be deployed in a structure other than a sensor cable, in accordance with other embodiments of the invention. For example, FIG. 16 depicts a cross-sectional view of a conduit 620, which may contain the optical fibers 575 and the resistive heating elements 565, in accordance with other embodiments of the invention. In this regard, the conduit 620 provides mechanical protection and support and may be filled with an inert and thermally conductive fluid 624. The fluid 624 may or may not be circulated during the use of the distributed temperature sensor, depending on the particular embodiment of the invention. However, if the conduit 620 is designed to support circulation, then the optical fibers 575 may be removed and replaced, for example, for purposes of replacing a damaged optical fiber.

It is noted that the conduit 620 may replace the sensor cable 580 of FIG. 13 between the upper 570 and lower 584 sub assemblies, or alternatively, the conduit 620 may extend from the region of interest 71 to the surface of the well. Thus, many variations are contemplated and are within the scope of the appended claims.

Figure 18:
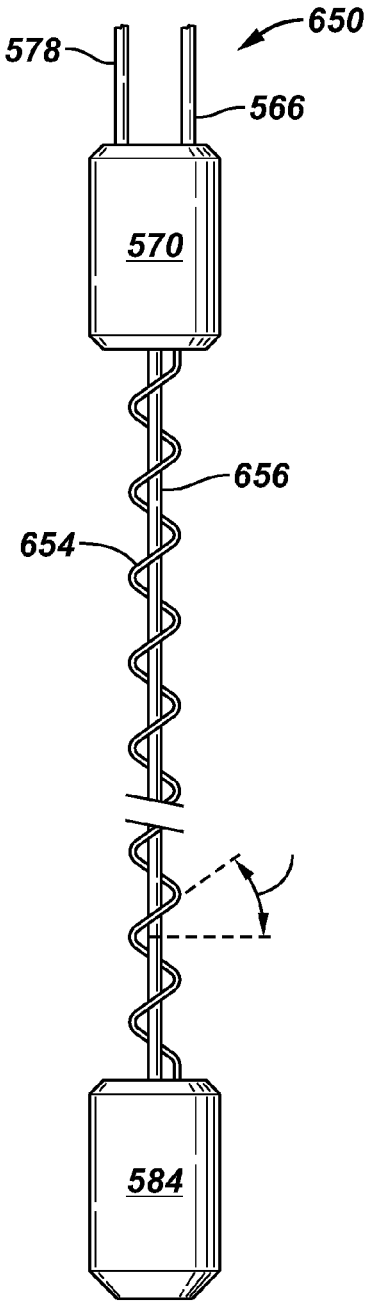
FIGS. 18 and 19 are schematic diagrams of fluid level indication subsystems according to other embodiments of the invention.

FIG. 18 depicts a fluid level indication subsystem 650 in accordance with another embodiment of the invention. In this embodiment of the invention, a sensor cable or conduit (represented by reference numeral 654) spirally, or helically, extends around a longitudinally extending mandrel 656, which supports the cable or conduit 654. the cable or conduit may contain any of the heater, optical and/or fluid elements that are described herein, and may be used with any of the techniques that are disclosed herein.

The mandrel 656 serves to support the lower sub assembly 584. The construction of the mandrel 656 permits free circulation of the fluid about the sensing cable or conduit 654; and the mandrel 656 is designed to have a relatively low thermal conductivity in the vertical direction.

The helical winding of the cable or conduit 654 is characterized by a helix angle called "α," which is chosen so that the spacing between the turns of the helix is substantially greater than the diameter of the sensor cable or conduit 654. If a conduit is used (instead of a cable) then the conduit may be formed into a self-supporting helix, and in accordance with some embodiments of the invention, the mandrel 656 may be eliminated.

The helical arrangement increases the fluid level resolution of the fluid level indication subsystem 650, relative to a fluid level subsystem in which the distributed temperature subsystem longitudinally extends through the region of interest. More specifically, every distributed temperature sensor has a minimum distance resolution, which is defined as the smallest separation between two points that can measure, or indicate, different temperatures. For a linear arrangement, this distance resolution is determinative of the minimum fluid level measurement distance. Thus, for a vertical sensing (i.e., longitudinally extending) cable or conduit, the minimum resolvable distance of the distributed temperature sensor is the same as the minimum fluid level measurement.

However, when the sensor cable or conduit is formed into a helix as shown in FIG. 18, the fluid level resolution is increased, i.e., the minimum fluid level measurement distance is decreased. This relationship may be described as follows:

$$l = \frac{h}{\cos(\alpha)}, \qquad \text{Eq. 1}$$

where "l" represents the change in length along the sensing optical fiber (i.e., the distributed temperature sensor); "h" represents the change in fluid level; and "α" represents the helix angle. Thus, as shown in Eq. 1, forming the sensor cable or conduit into a helix consequently significantly improves the fluid level resolution of the sensor.

Figure 19:
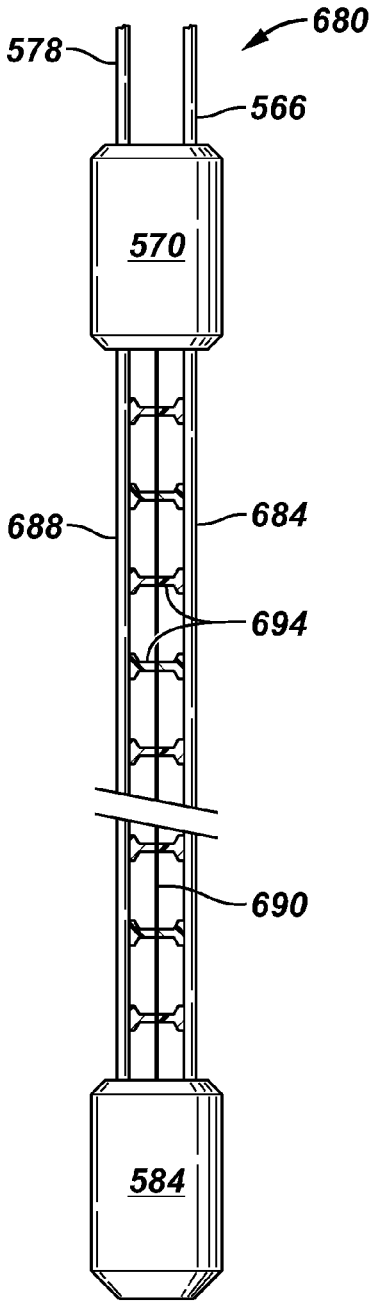

FIG. 19 depicts an exemplary embodiment of a fluid level detection subsystem 680 in accordance with yet another embodiment of the invention. The subsystem 680 includes two sensor cables 684 and 688, which extend between the upper 570 and lower 584 sub assemblies. Each sensor cable 684, 688, in turn, includes at least one distributed temperature sensor, similar to the sensor cable 580 of FIG. 13.

The two sensor cables 684 and 688 longitudinally extend downhole and are maintained a fixed distance apart by an arrangement of spacers 694 that radially extend from a longitudinally extending mandrel 690. The spacing of the sensor cables 684 and 688 allows free circulation of the surrounding fluid in the region of interest.

The material and construction of the mandrel 690 and spacers 694 are chosen to minimize the thermal conduction between the two sensor cables 684 and 688, other than the thermal conduction that occurs via the fluid medium, which surrounds the cables 684 and 688. At least one of the sensor cables 684 and 688 contains a heating element. Thus, for example, one of the sensor cables 684, 688 may be of similar construction to the sensor cable 580 of FIG. 13; and the other sensor cable 684, 688 may contain a distributed temperature sensor and not contain a heating element, or at least the heating element of this other sensor cable 684, 688 is not used.

Figure 21:
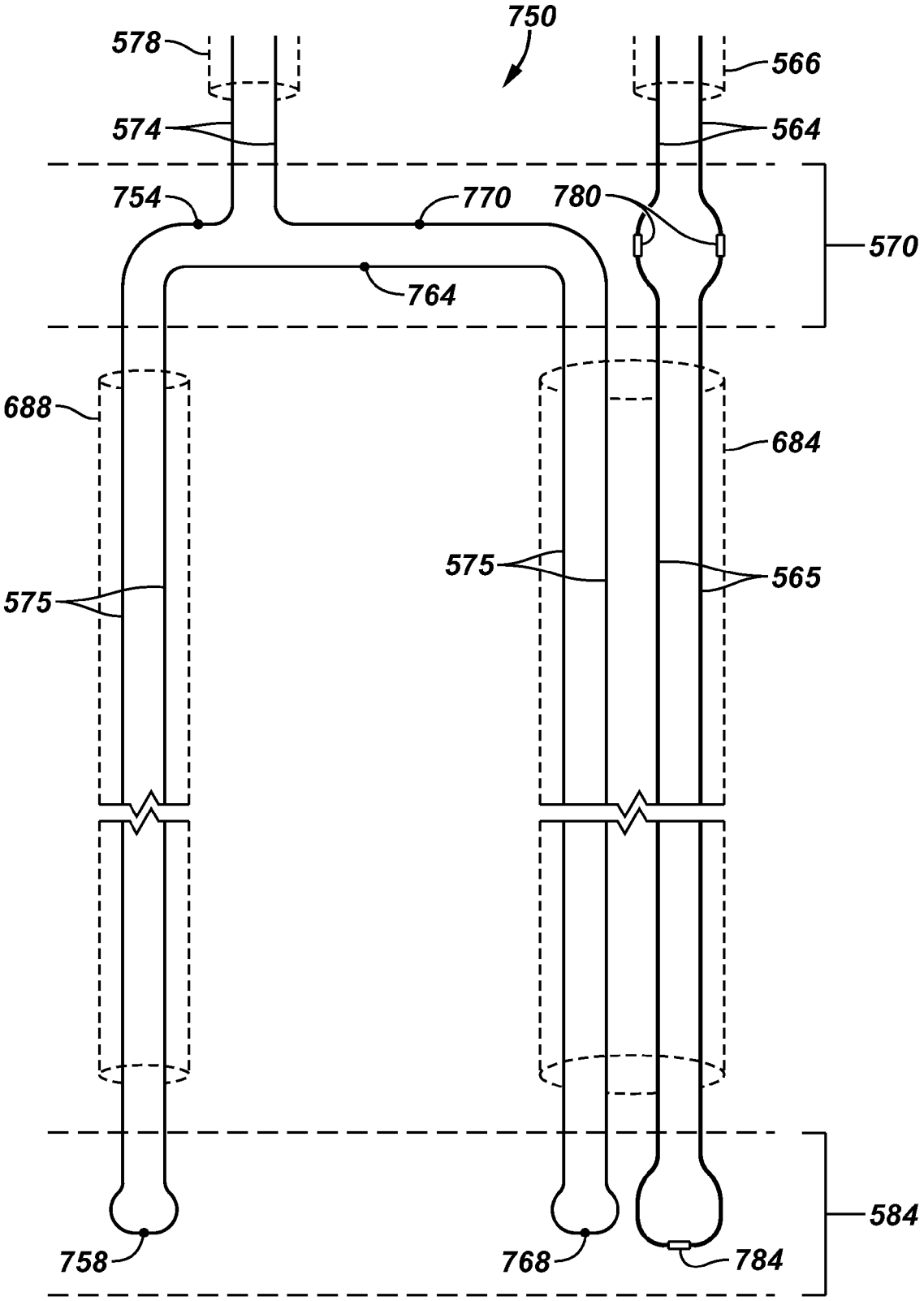
FIG. 21 is a schematic diagram illustrating optical and electrical connections of the fluid level indication subsystem of FIG. 19 according to an embodiment of the invention.

Referring to FIG. 21 in conjunction with FIG. 19, in accordance with some embodiments of the invention, the sensor cables 684 and 688 may be optically and electrically connected according to a schematic connection diagram 750. For this example, the sensor cable 688 includes optical fibers 575 and the sensor cable 684 includes optical fibers 575 that are connected together at optical splices 754, 758, 764, 768 and 770 to form an optical loop.

The optical loop begins at the surface of the well; extends through one of the optical fibers 574 of the cable 578; extends downhole through one of the optical fibers 575 of the sensor cable 688 to the lower sub assembly 584; returns uphole through the other optical fiber 575 of the sensor cable 688; and is connected at its upper end to the upper end of one of the optical fibers 575 of the sensor cable 684. From this point, the optical loop follows the optical fibers 575 of the sensor cable 684 downhole to where the lower end of this optical fiber 574 is spliced to the lower end of the other optical fiber 575 of the sensor cable 684. The optical path then continues uphole through the other optical fiber 575 of the sensor cable 684, where the optical path extends to the surface of the well through the other optical fibers 574 of the cable 578.

As also depicted in FIG. 21, for this example, the sensor cable 688 does not contain any heating elements, and the sensor cable 684 contains heating elements 565. The heating elements 565 are connected together at their lower ends by an electrical connector 784. The upper ends of the heating elements 565 are connected via electrical connectors 782 to the electrical conductors 564 of the cable 578 that extends to the surface of the well to an electrical power source. Thus, a resistive heating loop is formed in the sensor cable 684.

For the arrangement that is depicted in FIGS. 19 and 21, a surface electrical power source may be operated intermittently to heat the sensor cable 684 such that the temperatures of both sensor cables 684 and 688 may be measured by their respective distributed temperature sensors.

More specifically, the temperature measurement that is acquired via the distributed temperature sensor of the sensor cable 684, which is the heated cable, depends primarily on the product of the thermal conductivity and the specific heat capacity of the surrounding medium. The temperature measurement that is acquired by the distributed temperature sensor of the unheated sensor cable 688 is a function of the actual temperature rise of the heated sensor cable 684, which is known from the measurements obtained from the cable 684 and the thermal conductivity of the intervening medium. From these two temperature measurements, the two properties of thermal conductivity and specific heat capacity may be separately determined to provide an improved discrimination of the fluid at each level in the region of interest. This may be of particular benefit in determining the positions of the fluid levels, where the properties of each of the two fluids are similar. Thus, in effect, two independent determinations of the fluid level location may be obtained.

It is noted that the temperature responses may be measured during the heating phase, during the cooling down period after the heat input is removed, or during both phases, depending on the particular embodiment of the invention.

Figure 20:
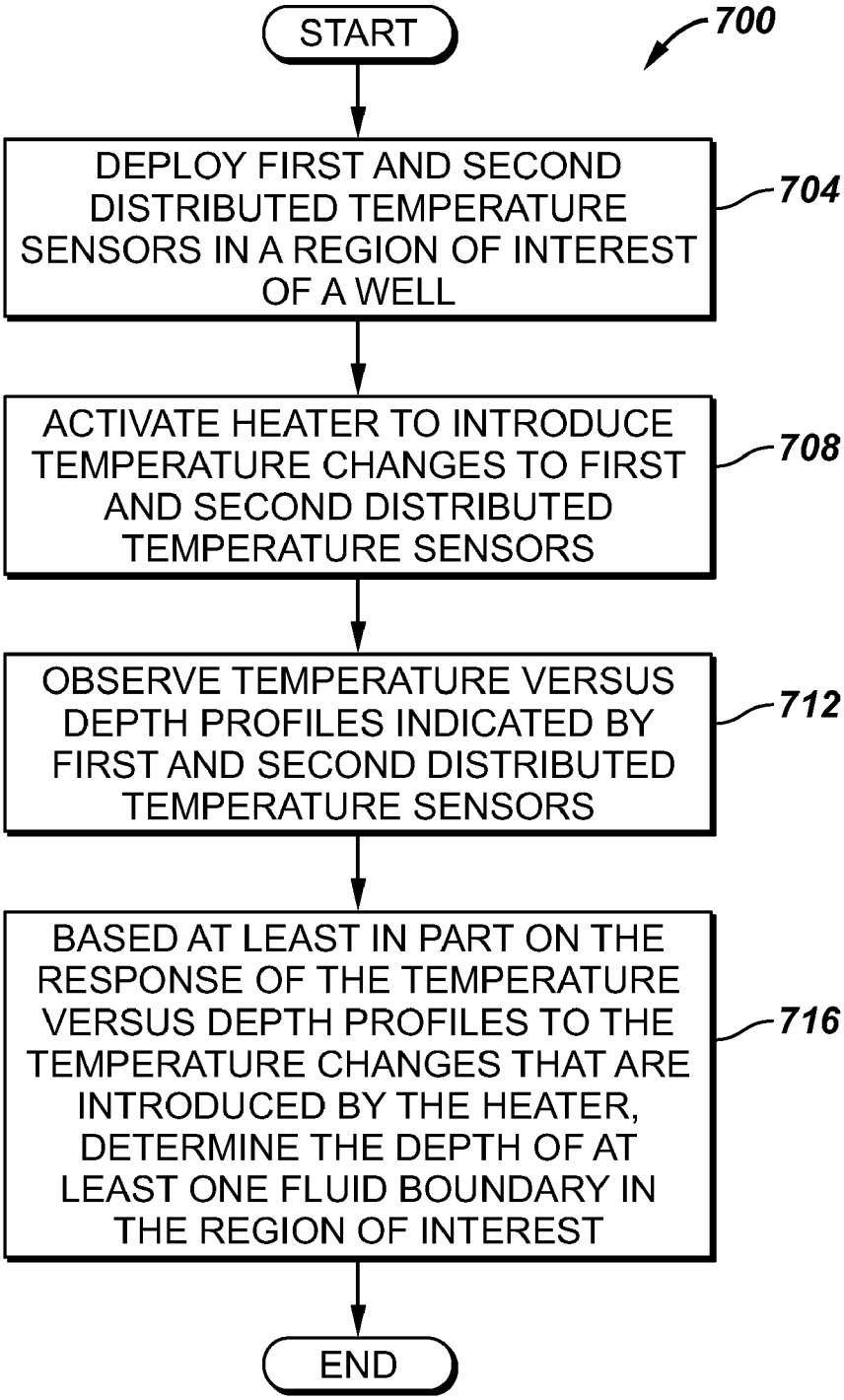
FIG. 20 is a flow diagram depicting a technique to use multiple sensor cables that contain distributed temperature sensors and at least one heating element to determine the depth of at least one well fluid layer boundary according to an embodiment of the invention.

Thus, referring to FIG. 20, a technique 700 may be used in accordance with some embodiments of the invention for purposes of identifying the depth at least one fluid layer in a region of interest. Pursuant to the technique 700, first and second distributed temperature sensors are deployed in a region of interest of a well, pursuant to block 704. A heater is activated (block 708) to introduce temperature changes to the first and second distributed temperature sensors, and the temperature versus depth profiles, which are indicated by the first and second distributed temperature sensors are observed, pursuant to block 712. Based at least in part on the responses of the temperature versus depth profiles to the temperature changes that introduced due to the activation of the heater, the depth of at least one fluid boundary in the region of interest is determined, pursuant to block 716.

In embodiments of the invention where the sensor cable or conduit contains a pair of optical fibers and the fibers are configured as a loop, the distributed temperature sensor effectively provides two temperature versus depth profiles of the region of interest (i.e., the cable/conduit has two distributed temperature sensors). Provided that these two measurements have statistically independent sources of error, as is generally the case with optical distributed temperature sensors, the two measurements at each depth may be averaged to improve the resolution of the measured temperature.

It is noted that the distributed temperature sensor measurement system 100 or another system may contain a processor-based subsystem to conduct the distributed temperature sensor measurements and determine the depths of the fluid interfaces in accordance with any of the techniques and systems that are described herein. Thus, the processor-based system may control a fluid pump, electrical power source, downhole heater element, optical signal generation, optical signal sensing, optical signal processing, etc., for purposes of implementing the systems and performing the techniques that are disclosed herein.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

changing the temperature of a local environment of a distributed temperature sensor deployed in a region of the well, the region containing at least two different well fluid layers, wherein the distributed temperature sensor is deployed in a U-shaped conduit which forms a loop through the well, and wherein the act of changing the temperature comprises heating or cooling a fluid circulated in the conduit that contains the distributed temperature sensor;

using the sensor to acquire measurements of a temperature versus depth profile; and determining the depth of a boundary of at least one of the well fluid layers based at least in part on a response of the temperature versus depth profile to the changing of the temperature.

* * * * *